United States Patent [19]

Mensies

[11] Patent Number: 4,801,843

[45] Date of Patent: Jan. 31, 1989

[54] DISPLAY TUBE WITH MAGNETIC CORRECTION ELEMENTS

[75] Inventor: Otto Mensies, Eindhoven, Netherlands

[73] Assignee: U.S. Philips Corporation, New York, N.Y.

[21] Appl. No.: 104,547

[22] Filed: Sep. 29, 1987

Related U.S. Application Data

[63] Continuation of Ser. No. 837,922, Mar. 10, 1986.

[30] Foreign Application Priority Data

Mar. 20, 1985 [NL] Netherlands ..... 8500807

[51] Int. Cl.[4] ..... H01J 29/56

[52] U.S. Cl. ..... 313/421; 313/431; 313/442

[58] Field of Search ..... 313/382, 389, 421, 431, 313/442, 452, 449, 413, 414, 447, 448

[56] References Cited

U.S. PATENT DOCUMENTS 3,887,830 6/1975 Spencer ..... 313/443

4,268,777 5/1981 van Roosmalen ..... 313/448 X 4,424,466 1/1984 Zeppenfeld ..... 313/433

4,468,587 8/1984 Sluyterman ..... 313/413

4,591,755 5/1986 Kornaker ..... 313/414 X

*Primary Examiner*—David K. Moore

*Assistant Examiner*—K. Wieder

*Attorney, Agent, or Firm*—Robert J. Kraus

[57] ABSTRACT

Display tube such as a projection television display tube or a DGD tube (DGD=Data Graphic Display), including an electron gun (5) in an evacuated envelope (1) for generating an electron beam (6) which is focussed to a spot (8) on a display screen (7) with the aid of an electrostatic focussing lens (27, 30) and which is deflected across the display screen (7) in two mutually perpendicular directions (x, y). If a correction structure (37) consisting of magnetic half-hard material is provided in such a tube in the proximity of the focussing lens (27, 30) and coaxially of the gun axis (20) in which at least one magnetic 2N pole (N≧2) is induced for correcting spot shape errors, a high spot quality can be realized with low-cost deep-drawn lens electrodes (27, 30).

5 Claims, 1 Drawing Sheet

DISPLAY TUBE WITH MAGNETIC CORRECTION ELEMENTS

This is a continuation of application Ser. No. 837,922, filed Mar. 10, 1986.

BACKGROUND OF THE INVENTION

The invention relates to a display tube comprising an electron gun in an evacuated envelope for generating an electron beam which is focussed on a display screen with the aid of an electrostatic focussing lens and which is deflected across the display screen in two mutually perpendicular directions.

A display tube of this type is used, for example, in a device for displaying symbols and/or characters generated by, for example, a computer. Such a tube is also referred to as a D.G.D. tube (DGD=Data Graphic Display). Such a display tube may, however, alternatively be a projection television display tube or another type of display tube in which only one electron beam is generated.

A display tube of this type is known from "Philips Data Handbook", Electron tubes, part 8, July 1983, Monitor Tubes.

An electron beam spot of very high quality is desired on the display screens of both projection television display tubes and DGD tubes. This is a spot having very determined, preferably small dimensions and without a halo surrounding the spot. For example, the spot must be circular. In the gun types known hitherto having focussing lens electrodes deep-drawn from sheet material it has been difficult to realize the desired spot circularity.

Further, an asymmetrical halo (haze) may occur around the core of the spot when the triode grids of the electron gun are not exactly in alignment. This asymmetry of the core halo results in an enlargement of the spot upon focussing to the starting point of the halo (the situation in which the halo has completely disappeared).

SUMMARY OF THE INVENTION

It is therefore an object of the invention to provide a display tube in which it is possible to use low-cost electrodes deep-drawn from sheet material in which a high spot quality is realized.

According to the invention a display tube of the type described in the opening paragraph is characterized in that a correction structure of magnetic half-hard material is provided in the proximity of the focussing lens and coaxially of the gun axis in which at least one magnetic 2N pole is induced, with $N \geqq 2$.

The invention is based on the recognition of the fact that, inter alia, the mechanical misalignment of the apertures in the focussing lens electrodes has four-pole and higher order pole effects on the electron beam. These effects cause the electron beam, and hence the spot on a display screen to be non-circular.

These influences can be compensated by means of oppositely oriented magnetic 4-pole fields and magnetic multiple fields of an order higher than 4 (6-pole; 8-pole; 10-pole, etc.). These fields, which depend on the way in which the shape of the apertures in the focussing lens electrodes deviates from the circular shape, are generated, within the scope of the invention, by means of a correction structure in which at least one magnetic 2N pole ($N \geqq 2$) is induced. If this structure is present in the display tube, it may advantageously serve a second purpose. By inducing also a magnetic dipole therein, it is possible to correct centering errors. A centering error occurs when the non-deflected electron beam is not focussed to a spot in the center of the display screen. This is a result of misalignment of the gun.

Due to possible eccentricities and tilts of the gun electrodes located close to the cathode, an unwanted beam deflection may be effected so that the beam does not pass through the center of the focussing lens. In that case the beam is askew and eccentric in the focussing lens. When the anode voltage and/or focussing voltage is varied, the spot on the display screen will thereby change its position (referred to as beam displacement). The fact that the electron beam does not pass centrally through the focussing lens results in a non-symmetrical halo round the spot. This type of error can be corrected by providing a bipolar field in a second structure of magnetizable material, in the triode part of the gun close to the cathode.

A first preferred embodiment of a display tube according to the invention is characterized in that, viewed in the direction of propagation of the electron beam, an electron beam alignment structure of magnetic half-hard material in which a magnetic dipole is induced is provided coaxially around the gun axis just behind the cathode. By this structure the electron beam can be passed through the center of the focussing lens and the core halo asymmetry can be corrected.

A display tube according to the invention can be constructed in such manner that the focussing lens, viewed in the direction of propagation of the electron beam, consists of a first and a second cylindrical focussing lens electrode, the first electrode extending coaxially into the second electrode, the correction structure being secured to the edge of the second electrode remote from the first electrode. By securing the correction structure behind the lens gap of this accelerating focussing lens, the electron beam shape can be corrected in a very effective manner. In fact, the corrected beam does not subsequently pass through an electron lens where it could be distorted again. In addition, it is easy in practice to secure a correction structure in the form of a ring to the edge of a cylindrical electrode. The (annular) structure can alternatively be provided in the second focussing lens electrode near the edge of the first focussing lens electrode. It is even possible to provide the (annular) structure just in front of the focussing lens, for example, at the cathode-facing extremity of the second focussing lens electrode. The corrected beam then, however, still passes through the focussing lens.

A display tube according to the invention may furthermore be constructed in such manner that the electron gun comprises a cathode, a control electrode, an anode, a prefocussing electrode and a first focussing lens electrode and that the beam alignment structure is secured coaxially around the gun axis to the cathode-facing side of the first focussing lens electrode.

BRIEF DESCRIPTION OF THE DRAWING

The invention will now be described in greater detail by way of example with reference to the drawing in which.

DESCRIPTION OF THE PREFERRED EMBODIMENTS

Figure 1:
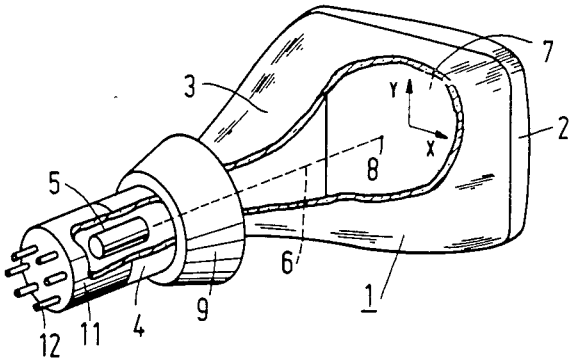
FIG. 1 is a perspective view, partly broken-away, of a display tube according to the invention.

The display tube shown in FIG. 1 comprises a glass envelope 1 consisting of a display window 2, a cone 3 and a neck 4 which accommodates an electron gun 5 for generating an electron beam 6. This electron beam 6 is focussed to a spot 8 on a display screen 7. The display screen 7 is provided on the inside of the display window 2. The electron beam is deflected across the display screen 7 in two mutually perpendicular directions X, Y with the aid of the deflection coil system 9. The tube is provided with a base 11 having connection pins 12.

Figure 2:
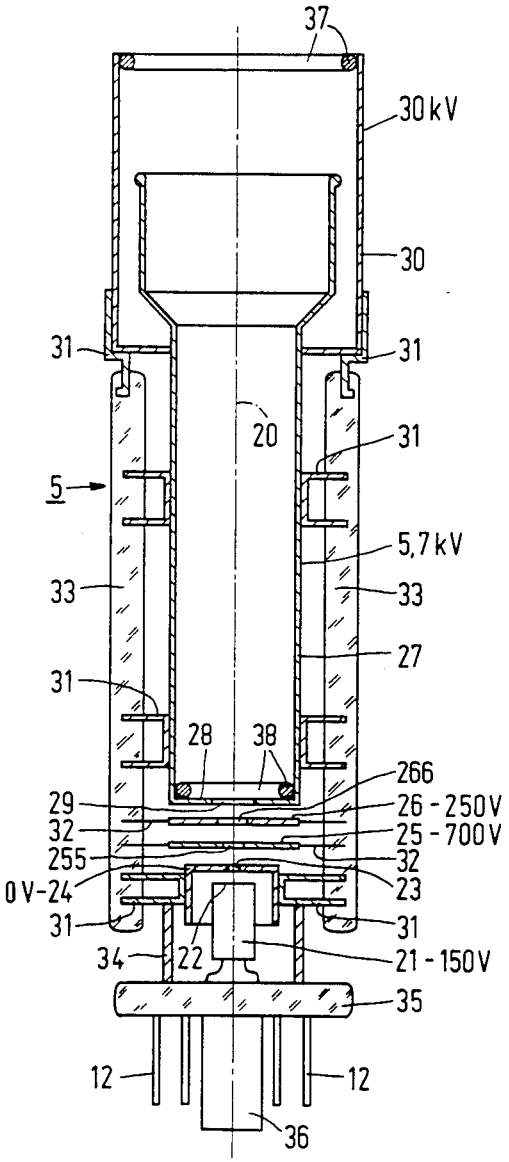
FIG. 2 is a longitudinal section through an electron gun for a display tube as shown in FIG. 1.

FIG. 2 is a longitudinal section through an electron gun 5 as shown in FIG. 1. This electron gun comprises, centered along an axis 20, a cathode 21 having an emitting surface 22, a control electrode 24 provided with an aperture 23, a first anode 25 provided with an aperture 255, a prefocussing electrode 26 provided with an aperture 266, a first cylindrical focussing lens electrode 27 having a bottom 28 with an aperture 29 and a second cylindrical focussing lens electrode 30. The electrodes 24, 25, 26, 27 and 30 are supported on glass rods 33 by means of brackets 31 and electrode pins 32 sealed therein. The entire electron gun assembly is secured by means of the mounting pins 34 in a glass bottom plate 35 provided with an exhaust tube 36 and connection pins 12. The connection wires between the various gun electrodes and the connection pins are omitted so as not to make the drawing unnecessarily complicated.

A ring 37 of a magnetic half-hard material as described for example in German Patent Specification No. 2,612,607, is provided at the edge of the second focussing electrode 30. This material consists of, for example, an alloy of Fe, Co, V and Cr, which alloy is known under the trade name Koërflex (a trademark of the firm of Krupp). No welding operation may be performed on this ring, because otherwise its magnetic properties change. Therefore the ring is secured by means of a number of clamps not shown in the drawing. The gun assembly shown in FIG. 2 is inserted into the neck 4 of the tube (see FIG. 1), positioned and subsequently sealed with glass plate 35. Subsequently at least one magnetic 2N pole ($N \geqq 2$) and a magnetic dipole are externally induced in the ring 37 after the tube is finished, dependent on the observed errors in the spot shape and location of the spot of the non-deflected electron beam. The ring 37 is magnetized, for example, in a manner and with the aid of a magnetizing device as described in the U.S. Pat. No. 4,220,897 already referred to. As N is larger, the required strength of the 2N pole generally decreases, in other words, when a 4-pole is present, this pole has the greatest strength. When a ring 38 which is also magnetizable is provided close to the cathode 21 and with this ring appropriately magnetized, it is possible to pass the electron beam accurately through the center of the focussing lens constituted by the electrodes 27 and 30. This is effected by magnetizing the ring 38 as a dipole. The distance between the two magnetized rings is 63 mm in this case. Conventional voltages on the electrode are shown in the Figure. The operation on one and two magnetized rings will now be described in detail with reference to the following Table:

| | A | | | B | | | C | | |
|---|---|---|---|---|---|---|---|---|---|
| | ds (mm) | | $V_{foc}$ | ds (mm) | | $V_{foc}$ | ds (mm) | | $V_{foc}$ |
| I (mA) | x | y | (kV) | x | y | (kV) | x | y | (kV) |
| 0.1 | 0.4 | 0.4 | 6.40 | 0.4 | 0.4 | 6.30 | 0.475 | 0.375 | 6.20 |
| 2.0 | 0.65 | 0.45 | 5.81 | 0.5 | 0.5 | 5.75 | 0.375 | 0.375 | 5.71 |
| 4.0 | 1.0 | 0.7 | 5.82 | 0.8 | 0.8 | 5.75 | 0.60 | 0.60 | 5.70 |

The first column states three values of electron beam currents I (in mA).

The second column states (under A) the spot dimensions ds (mm) in the x and y directions and the associated potential at focussing electrode 27, referred to as the focussing voltage $V_{foc}$ (kV) for a gun in which the rings had not yet been magnetized.

The third column states (under B) also the spot dimensions ds (mm) in the x and y directions and the associated $V_{foc}$. In this case ring 37 has been magnetized in such a manner that the beam and the spot were circular in the focussed state. In the case of larger beam currents the spot is also smaller in surface area than in the situation shown under A.

The fourth column states (under C) the spot dimensions ds (mm) in the x and y directions and the associated $V_{foc}$. In this case ring 38 had also been magnetized optimally (as a dipole). Particularly in the case of larger beam currents the spot dimensions considerably decrease with respect to the situation shown in the second column (under A).

The diameter of electrode 27 is 10 mm in its narrowest part and 16 mm in its wider part. The length of electrode 27 is 53.5 mm. The diameter of electrode 30 is 20 mm. The diameter of both aperture 255 and aperture 23 is 0.4 mm. The diameter of aperture 266 is 1.5 mm and that of aperture 29 is 2 mm. The distance between the cathode surface and electrode 24 is 0.065 mm. The distance between the electrodes 24 and 25 is 0.150 mm. The distance between the electrodes 25 and 26 is 0.65 mm and that between the electrodes 26 and 27 is 1.4 mm. The thickness of electrode 24 is 0.1 mm. The thickness of electrode 25 is 0.25 mm, of electrode 26 0.4 mm, of electrode 27 0.25 mm and of electrode 30 also 0.25 mm. The Figure is an approximately 1.5 to 2 times enlarged illustration of the actual electron gun.

It stands to reason that the magnetizable structure is not limited to a ring and may alternately have a different shape. It is, for example, possible to position a plurality of magnetizable elements in a ring consisting of non-magnetic material and subsequently mount this ring in the gun. It is also possible for the focussing lens to be a unipotential lens or a multi-stage lens.

What is claimed is:

1. In a display tube comprising an envelope containing a luminescent screen and an electron gun having a central axis for producing an electron beam directed at said screen, said electron gun including, successively-centered along said axis;

(a) a cathode for emitting electrons;

(b) means for forming the emitted electrons into the electron beam; and (c) first and second cylindrical focusing electrodes for producing therebetween an electric focusing lens field for focusing the electron beam into a spot on said screen, each of said electrodes having a front end closer to said screen then the rear end thereof, the first electrode extending partially within the second electrode so as to leave a space between the front ends of said electrodes within which said electric field extends;

the improvement comprising first permanent magnet means disposed in said space between the front ends of said electrodes and producing a 2N pole magnetic field, N being an integer, which acts on said beam so as to compensate for asymmetries of said electric focusing lens field which adversely affect circularity of said beam.

2. A display tube as in claim 1 and further including second permanent magnet means disposed in the proximity of the rear end of said first electrode and producing a dipole magnetic field which acts on said beam so as to compensate for asymmetries in an electric field produced by at least one of the beam-forming electrodes which would cause the electron beam to deviate from a path of propagation along the axis, thereby effecting passage of said electron beam centrally through said electric focusing lens field.

3. A display tube as in claim 1 or 2 where said first permanent magnet means also produces a dipole magnetic field which acts on said beam so as to compensate for errors in the position of the spot produced by said beam on said screen.

4. A display tube as in claim 1 or 2, wherein said first permanent magnet means is in the form of a ring secured to the front end of said second focusing electrode.

5. A display tube as in claim 1 or 2 wherein said second permanent magnet means is in the form of a ring secured to the rear end of said first focusing electrode.

* * * * *